US007614813B1

(12) United States Patent
Yande

(10) Patent No.: US 7,614,813 B1
(45) Date of Patent: Nov. 10, 2009

(54) GROUT DISPENSER

(76) Inventor: Chandrakant R. Yande, 6 Bolfmar Ave., West Windsor, NJ (US) 08550

( * ) Notice: Subject to any disclaimer, the term of this patent is extended or adjusted under 35 U.S.C. 154(b) by 237 days.

(21) Appl. No.: 11/769,275

(22) Filed: Jun. 27, 2007

Related U.S. Application Data

(63) Continuation-in-part of application No. 11/611,546, filed on Dec. 15, 2006, now abandoned.

(51) Int. Cl.
*B43K 5/18* (2006.01)
*B43K 23/02* (2006.01)
*A46B 11/00* (2006.01)

(52) U.S. Cl. ..... 401/150; 401/5; 401/131

(58) Field of Classification Search ..... 401/5, 401/131, 148, 174, 150, 169
See application file for complete search history.

(56) References Cited

U.S. PATENT DOCUMENTS 1,623,577 A * 4/1927 Coe ..... 401/48
3,052,909 A * 9/1962 Russell ..... 401/48
3,540,837 A * 11/1970 Pascucci ..... 43/124
3,735,545 A 5/1973 Bernett
3,964,854 A 6/1976 Groeneveld
4,988,272 A 1/1991 Nolan
5,302,043 A 4/1994 Velliquette
5,571,538 A 11/1996 Cloud
5,740,653 A 4/1998 Dubizhansky
6,260,743 B1 * 7/2001 Mazzenga ..... 222/611.2

* cited by examiner

*Primary Examiner*—David J. Walczak
*Assistant Examiner*—Ryan A. Varnum
(74) *Attorney, Agent, or Firm*—Crossley Patent Law; Mark A. Crossley

(57) ABSTRACT

A grout dispenser which dispenses a grout mixture from a container through a tracking square-toothed-shaped nipple having an off-on valve and extrudes the mixture into spaces between previously-set tiles. A utility stand, a grout float device and a tracking wheel to maintain a straight line are included. In use, the strip glides over the edges of the installed tiles on a predetermined width, spaces or tracks. By gliding over the uncured grout, mortar, the float gives the spaces or tracks a concave appearance.

10 Claims, 16 Drawing Sheets

GROUT DISPENSER

BACKGROUND OF THE INVENTION

This invention relates to a grout dispenser with a stand and a float and an improved method for grouting the joints of the installed floor tiles and, more particularly, relates to a compressible grout dispenser with a parallelepiped nipple and a wheeled float.

DESCRIPTION OF THE PRIOR ART

Prior antiquated grouting tools are labor-intensive and grout-wasting. Grout is applied between the joints of flooring tiles during installation using various methods. The grout takes on a concave appearance when applied by using a hand float. While adhering the floor tiles to sub-flooring is a relatively easy task, a tremendous amount of manual labor to apply grout between floor tile joints is required. Kneeling on hands and knees is necessary to apply grout. Some previous inventions provide some solutions to the problems inherent with kneeling and bending down during the grout application process, while other inventions teach apparatus to level out grout so that it does not have a concave appearance when applied between floor tiles. U.S. Pat. No. 5,740,653, issued to Dubizhansky, is one such example, in that it discloses a method for grouting tile which comprises applying a protective layer over the tile prior to grouting and then removing this layer after the grouting has occurred. However, as can be seen from this description, this method is labor-intensive U.S. Pat. No. 3,735,545, issued to Bernett, discloses a method for grouting tile which comprises adding a property-improving material to the grout before it is applied. Again, this highlights how existing grouting tools and method for applying grout still remain quite labor-intensive and cumbersome to use in practice.

U.S. Pat. No. 4,988,272, issued to Nolan, teaches a simple effective tool for finishing jointing; however, such tool requires kneeling and bending and requires one to squeeze the container or cylinder in order to extrude the grouting material, while further restricting the amount of grouting material instantly available during an application without having to re-fill or replace the source of the grouting material.

U.S. Pat. No. 3,964,854, issued to Groeneveld, illustrates a device for finishing joints between tegular elements applied to a surface.

Many prior art patents, uniform application of grout between joints is achieved by the combined use of removable spacers and an applicator of low viscosity gout sealant. Also, a conventional way to finish the grouting is to use a bristle or a soft material.

U.S. Pat. No. 5,302,043, issued to Velliquette, teaches a rotatable striper wheel made of absorbent material which is automatically saturated from a gravity-fed sealant contained in a squeeze bottle. It also teaches a disposable grout sealant applicator, which is nothing but a compressible bottle for ready-mixed grout and illustrates the problem of having to continually press the applicator for continuous application and consistent grout thickness, while also bending over and kneeling down to apply the grout between tiles for flooring. In addition, this device does not hold enough grout to finish many feet of grouting. Application of grout using this device and similar devices often leads to cramps in hands, lower back strain from long hours of bending and kneeling to apply grout 11 between flooring tiles, and does not lend itself to easy application of a desired consistent thickness and acceptable shape of grout.

U.S. Pat. No. 5,571,538, issued to Cloud, illustrates a device designed to contain a large quantity of grout in a tubular handle, has a valve and it being gravity fed. The applicator can be used while standing or sitting and there is no kneeling. A worker has to work hard to drag the nozzle in the tracks of the installed tiles. For the sealant flow the entering air has to control by a finger or a thumb. While the sealant is flowing in the tracks of the installed tiles the concave shape cannot be formed until the grout is semi hardened. The device has a limited use.

SUMMARY OF THE INVENTION

The present invention is a grout dispenser that comprises a dispenser, a utility stand and a grouting float. The dispenser dispenses a grout mixture of predetermined thickness from a cylindrical container through a square-toothed-shaped nipple that extrudes or feeds out the grout mixture into spaces in between previously-set tiles. The dispenser covers all types of tracks and it includes a cylindrical container, a compressible piston with a shaft and a handle, and a tracking square-toothed-shaped nipple. While in use, the grout within the grout dispenser is compressed by the piston and also by the force of gravity. The dispenser also includes a tracking railroad-like wheel, which has an outer, around its circumference and it travels in the tracks of the installed tiles. The nipple and the tracking wheel travel together through the tracks for straight line. A utility stand is to be used whenever the cylindrical container is to be filled with grouting of predetermined thickness. The nipple itself includes an orifice with an off-on valve. The grouting float has a body with two wheels, a shaft, a handle, and a rectangular strip of material, preferably plastic. A rod is lodged on the center of the angular strip, which is parallel to the spaces or tracks of the installed tiles.

In use, the strip glides over the edges of the installed tiles on a predetermined width, spaces or tracks. By gliding over the uncured grout, mortar, the float gives the spaces or tracks a concave appearance. The length-wise convex with bar/rod, with perpetual longitudinal up-down movement guides the workers to follow the spaces or tracks in a straight line. The rectangular strip with the convex shaped bar lodged in it, can be changed to ⅛", ¼", ⅜" and ¾" or to larger sizes for various types of grouting, including any other mortar material. With the support of horizontal pipes through the attached brackets to the cylinders/containers, $2^{nd}$, $3^{rd}$, and $4^{th}$ dispensers can be added for multi-combination use. Also the dispenser can be used for the wider grout joints.

There has thus been outlined, rather broadly, the more important features of a grout dispenser that the detailed description thereof that follows may be better understood and in order that the present contribution to the art may be better appreciated. There are, of course, additional features of the grout dispenser that will be described hereinafter and which will form the subject matter of the claims appended hereto.

In this respect, before explaining at least one embodiment of the grout dispenser in detail, it is to be understood that the grout dispenser is not limited in its application to the details of construction and to the arrangements of the components set forth in the following description or illustrated in the drawings. The grout dispenser is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present grout dispenser. It is important, therefore, that the claims be regarded as including such equivalent constructions insofar as they do not depart from the spirit and scope of the present invention.

It is therefore an object of the present invention to provide a grout dispenser which has all of the advantages of the prior art and none of the disadvantages.

It is another object of the present invention to provide a grout dispenser which may be easily and efficiently manufactured and marketed.

It is another object of the present invention to provide a grout dispenser which is of durable and reliable construction.

It is yet another object of the present invention to provide a grout dispenser which is economically affordable and available for relevant market segment of the purchasing public.

Other objects, features and advantages of the present invention will become more readily apparent from the following detailed description of the preferred embodiment when considered with the attached drawings and appended claims.

BRIEF DESCRIPTION OF THE DRAWINGS

FIG. 3B is a perspective view of a concave mechanism.

DESCRIPTION OF THE PREFERRED EMBODIMENT

Figure 1:
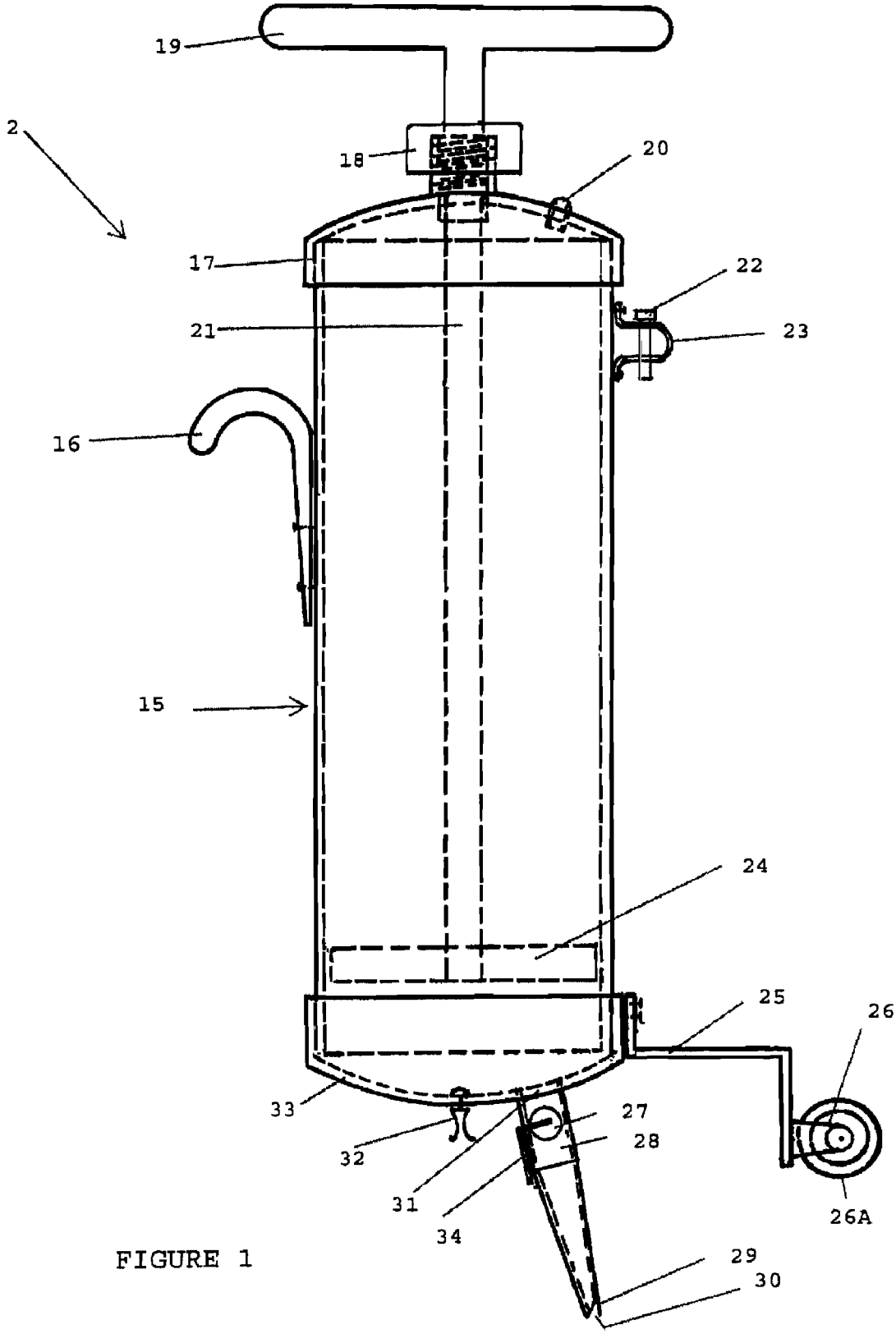
FIG. 1 is a side cutaway view of the grout dispenser.

With reference now to the drawings, and in particular to FIGS. 1 through 15 thereof, a new grout dispenser embodying the principles and concepts of the present invention and generally designated by the reference numeral 2 will be described.

As best illustrated in FIGS. 1 through 15, the grout dispenser 2 is shown. The specific wordings are used in these descriptions for fulfilling the requirements only and it is not to be assumed as a limitation on the present invention.

FIGS. 1, 2A, 2B, and 3 illustrate the basic components of the present grout dispenser 2. Referring to FIG. 1, grout dispenser 2 comprises a body 15, which is preferably cylindrical. The body 15 has an inner diameter and has two ends comprising a top end and a bottom end, with the top end of the body 15 including a removable cap 17 and the bottom end of the body 15 including a bottom cap 33.

A hook 16 is attached to the body 15 of the dispenser 2, with the hook 16 acting as both a storage hook and a carrying handle. Furthermore, the body 15 further includes a bracket 23, although the bracket 23 is truly only needed when two or more dispensers 2 are attached to one another for multi-use purposes.

The cap 17 has an attached piston shank locking/unlocking device 18 and a ventilation cap 20 attached to it. Furthermore, cap 17 has a rotatable piston handle 19, a shank 21, and a piston 24, which, when taken together, make a complete assembly of a reciprocating, hand-operated piston for pressing grout 85, located within the body, through a nipple 28 that is attached to the bottom cap 33. The nipple 28 has two ends comprising a first end and a second end, with the first end of the nipple 28 being the portion that is attached to the bottom cap 33. In addition to the pressure from the piston 24, gravity (a natural, downward force) also plays an important part in extruding the grout 85 through an orifice valve 27 located within the nipple 28 and out through an opening 30 on a square-toothed nipple 29 attached to the nipple 28. The opening 30 is on the second end of the nipple 28.

The shank 21 has two ends comprising a top end and a bottom end, with the top end of the shank extending through the cap 17. The piston 24 is attached to the bottom end of the shank 21 and has a diameter slightly smaller than that of the inner diameter within the body 15 of the grout dispenser 2. The handle 19 is attached to the top end of the shank 21.

An on/off handle 34 is attached to the orifice valve 27, with the valve 27 having open and shut positions. The handle 34 is to be lifted and removably attached to a snap lock 32 on the bottom cap 33 to place the orifice valve 27 into an open position. The handle 34 shown in FIG. 1 highlights the valve 27 in the "shut" position. Once the handle 34 is removably attached to the snap lock 32, the valve 27 comes into an "open" position, thereby allowing grout 85 within the body 15 of the dispenser 2 to exit the nipple 28 through the opening 30.

Figure 11:
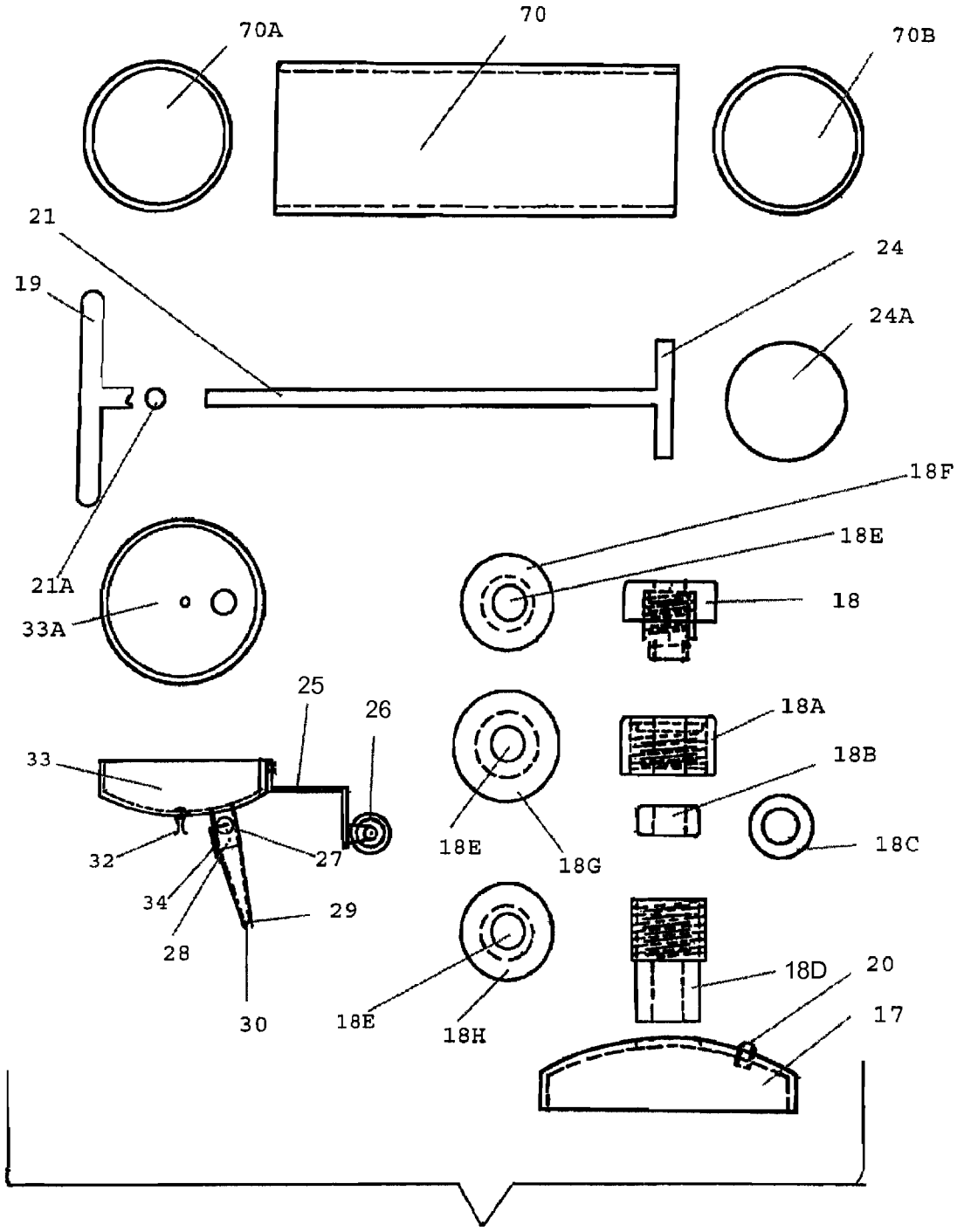
FIG. 11 is an exploded view of various parts of the grout dispenser after the grout dispenser has been disassembled.

A reciprocating piston 24 is shown in FIG. 1 in a depressed position. In addition, an external bracket 25 is attached to the bottom cap 33, with a tracking wheel 26 being attached to the bracket 25. The tracking wheel further includes an exterior band 26A, as shown in FIG. 11, that circumferentially surrounds the tracking wheel 26. When the dispenser is being pulled along while in use, the nipple 29 and the exterior band 26A travel just above tracks in between installed tiles on a floor surface, with the exterior band 26A sliding over and smoothing grout 85 that had just been lain in a particular track 58. The joint 31 indicates that the nipple 28 is attached permanently to the bottom cap 33 at an angle that provides a continuous, smooth flow of grout. A snap lock 32 is located at the bottom center of the bottom cap 33.

Figure 2A:
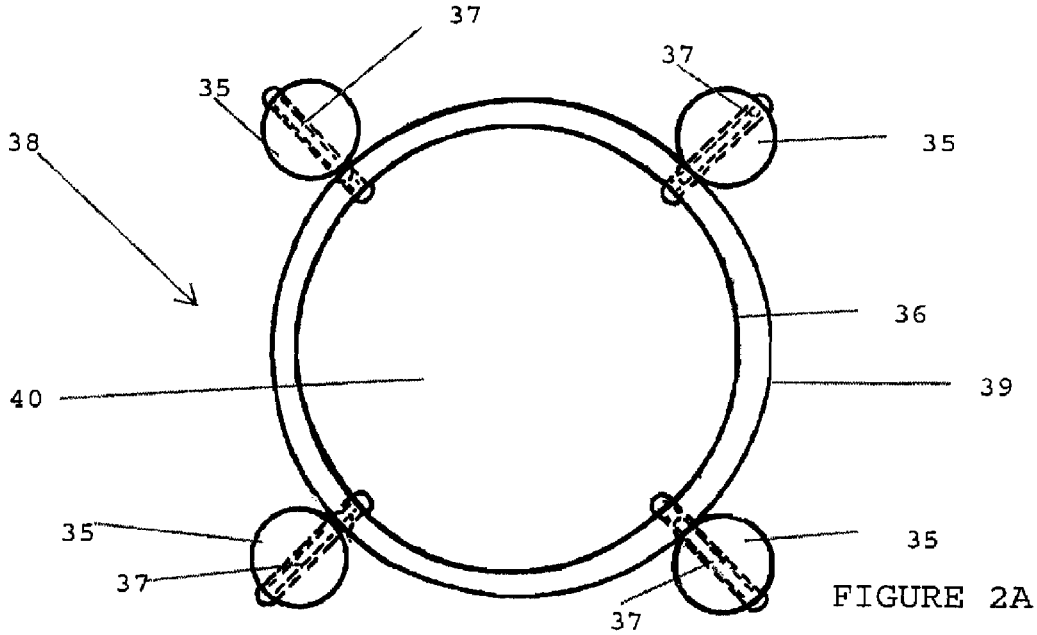
FIG. 2A is a top plan view of the utility stand associated with the grout dispenser.
Figure 2B:
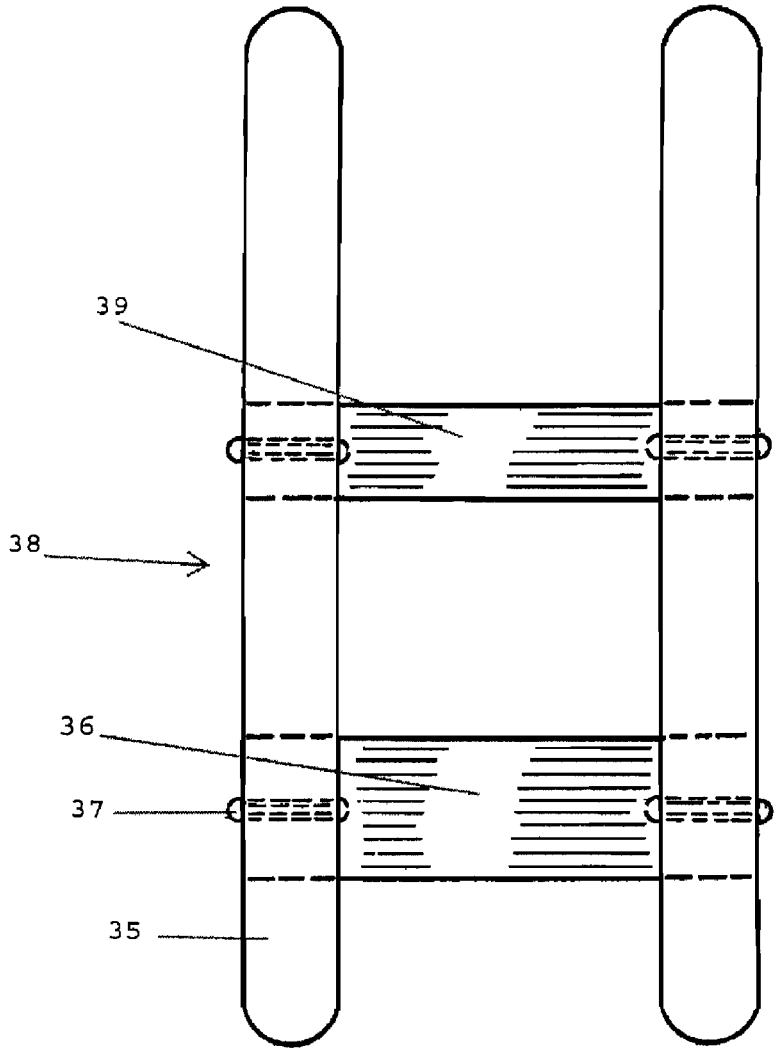
FIG. 2B is a side elevation view of the utility stand associated with the grout dispenser.

As best depicted in FIGS. 2A and 2B, the utility stand 38 acts as a supporting stand for the dispenser 2 (shown in FIG. 1). The dispenser 2 can be mounted on the utility stand 38 for temporary storage or also to assist an individual in filling the body 15 of the dispenser 2 with more grout 85. The stand 38 has four supports 35 which are attached to a lower circular band 36 and to an upper band support 39 with the hardware 37 at the designated eight points as shown in FIG. 2A. The four points of the bands 36 and 39 are divided into four quarters to accommodate the weight of the dispenser 2 when it is completely filled with grout or dispensing low viscous liquid. The combination of the bands 36 and 39 along with the supports 35 in the stand 38 create a space that is small enough that allows the body 15 of the dispenser 2 to be placed atop the stand 38 by placing the bottom cap 33 on top of the band 39. The height of the stand 38 is equal to approximately ¾ of the height of that of the dispenser 15. An aperture 40 formed by said lower circular band 36 allows the dispenser 2 to be placed within the stand 38.

As presented and illustrated in FIG. 3, a grout float device 41A with two wheels 43 are connected to a length-wise axle 42 which travels to the base 41B, which has two ends comprising a first end and a second end. The axle 42 also has two ends comprising a first end and a second end, with each end of the axle 42 exiting the respective end of the base 41B. Each end of the axle 42 is connected to a wheel 43. Inside washers 46 act like spacers between the base 41B and each of the wheels 43. Outside washers 45 are placed between the wheels 43 and the cotter pins 44, which are attached to each end of the axle 42 and act to prevent the wheels 43 from inadvertently being removed from the axle, especially while the grout float device 41A is in use. Support stand 47, which has two ends comprising a lower end and an upper end, is perpendicularly connected to the base 41B via the lower end of said base 41B. Furthermore, the upper end of support stand 47 is connected to a handle 48 which has two ends, a first end and a second end. The grout float device 41A is attached to the base 41B.

Figure 9:
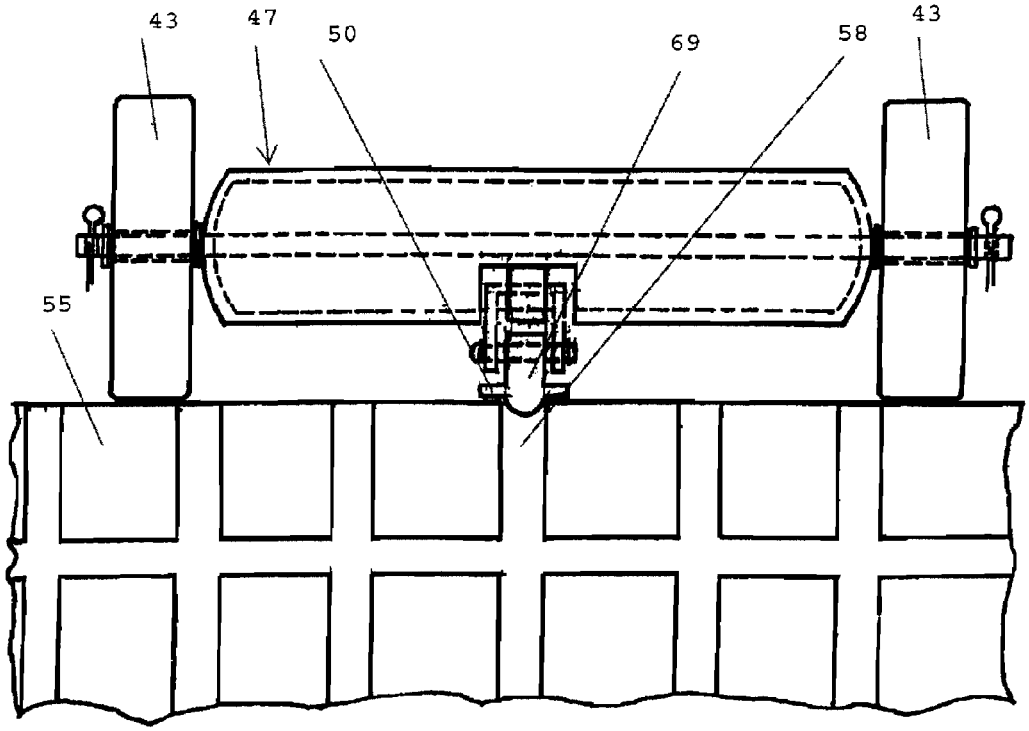
FIG. 9 is a top plan view of an alternate embodiment of the float associated with the grout dispense.

A cylindrical rod 49, the sliding wing 50 and the hinge mechanism 51 are all parts of the grout float device 41A. The sliding wing 50 is attached to the hinge mechanism 51, while the cylindrical rod 49 is attached to the sliding wing 50. As shown in FIG. 9, the middle section of the slot 68 of the base 41 acts as a hinge joint for hinge mechanism 51 for a motion in one plane. Before putting the axle 42 in the base 41, the hinge mechanism 51 needs to be threaded in through the slot 68 of the body, at which time, the axle 42 is threaded in the base 41. This is illustrated in FIG. 9, where it acts as a back support for the hook 51. The cylindrical rod 49 which is embedded in the wing 50 is attached to the hinge mechanism 51 with the pin 67 for up and down motion of the concave mechanism 69, as shown in FIGS. 3B and 9.

As the grout float device 41A goes over the uncured grout in the tracks 58 (illustrated in FIGS. 5 and 6) of the installed tiles, a worker may handle the grout float device 41A at any angle with the level of the floor tiles. The most comfortable angle in which the grout float device 41A should be pulled is approximately 60 degrees in relation the ground surface. While the worker pulls the grout float device 41A, the wings 50 slide over the edges of the installed tiles to support the cylindrical rod 49 as shown in FIG. 9. The levels of the wheels 43 and the wings 50 are the same as that of the installed tiles on the floor. It gives the rod 49 enough depth for creating the concave appearance of the uncured grout. The shank 47 of the base 41 should have enough length for the worker to pull the float 41 with the handle 48 in an up-right position.

Figure 4:
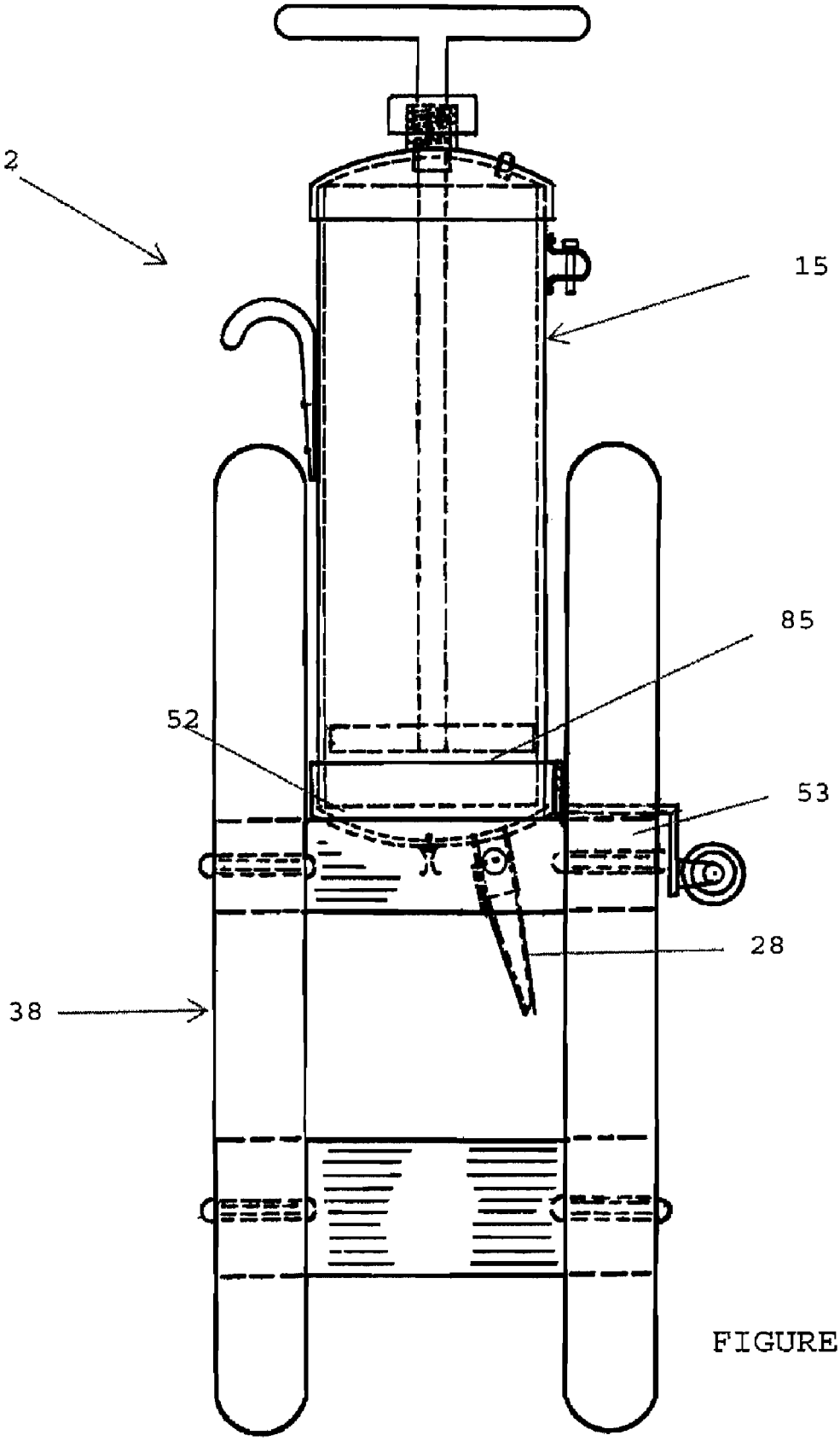
FIG. 4 is a side elevation view of the grout dispenser as it appears mounted on the utility stand.

As shown in FIG. 4, the dispenser 2 is supported by the upper circular band 39 of the stand 38 at the contact point 52. Similarly, the bracket 25 is supported by the upper circular band 39 of the stand 38 at the contact point 53. These supports protect the body 15 and the nipple 28 from damages and from badly handling the dispenser 2. Another important purpose of the stand 38 is to make it easy to fill and refill the dispenser 2. Also, the stand 38 can be used to park the dispenser while the worker is taking a break.

Figure 5:
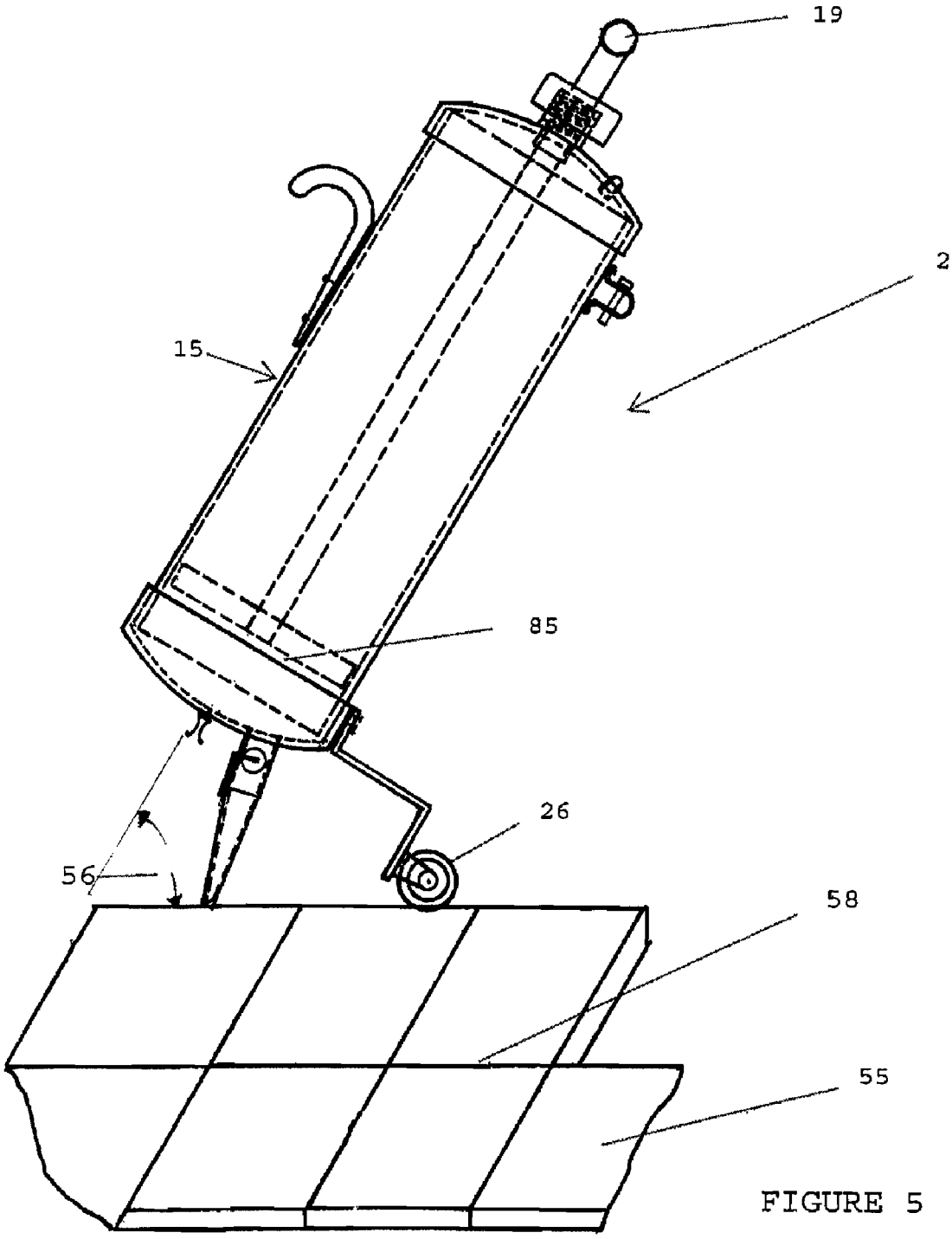
FIG. 5 is a side elevation view of a grout dispenser as it would actually appear in use installing grout in between a number of installed tiles.

As best presented and illustrated in FIG. 5, the dispenser 2 is shown at approximately a 60 degree angle, indicated by 56, with the installed tiles 55. As best depicted in the illustration, nipple 28 and tracking wheel 26 travel straight in the track 58 which is created by spacers for grouting the tiles. The body 15 is shown in FIG. 5 without grout mixture in it.

In order to use the dispenser 15, the worker has to first fill the dispenser 15 according to the demand or a need from the job. The widths of the nipple 29 and the tracking wheel 26 are similar and the distance between nipple 28 and tracking wheel 26 is fixed in a way that when a nipple 28 is put in the track and the worker lowers the body 15 towards him and forms an angle with the installed tiles, the body 26 automatically falls into the tracks.

Figure 6A:
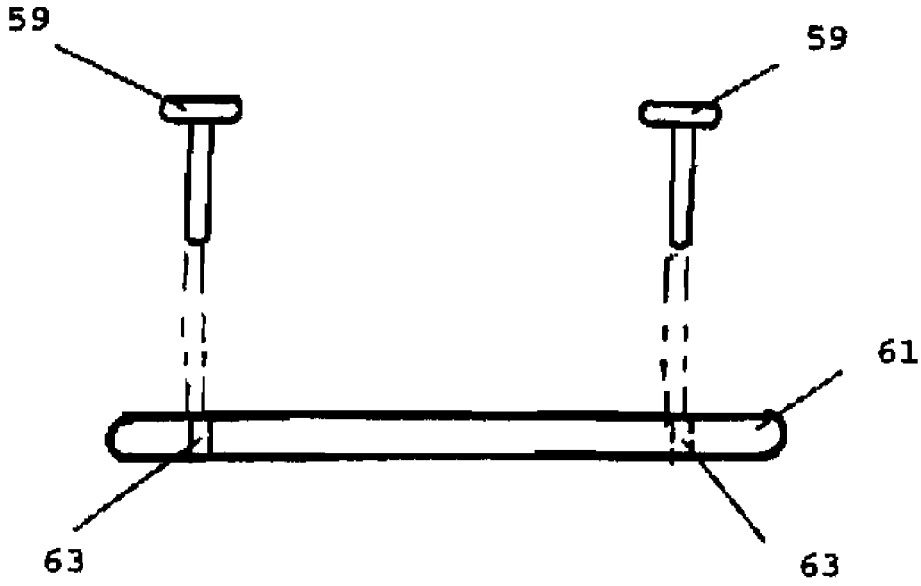
FIG. 6A is a cross-sectional exploded view of a supporting pipe/bar two slots for pin insertion.
Figure 6B:
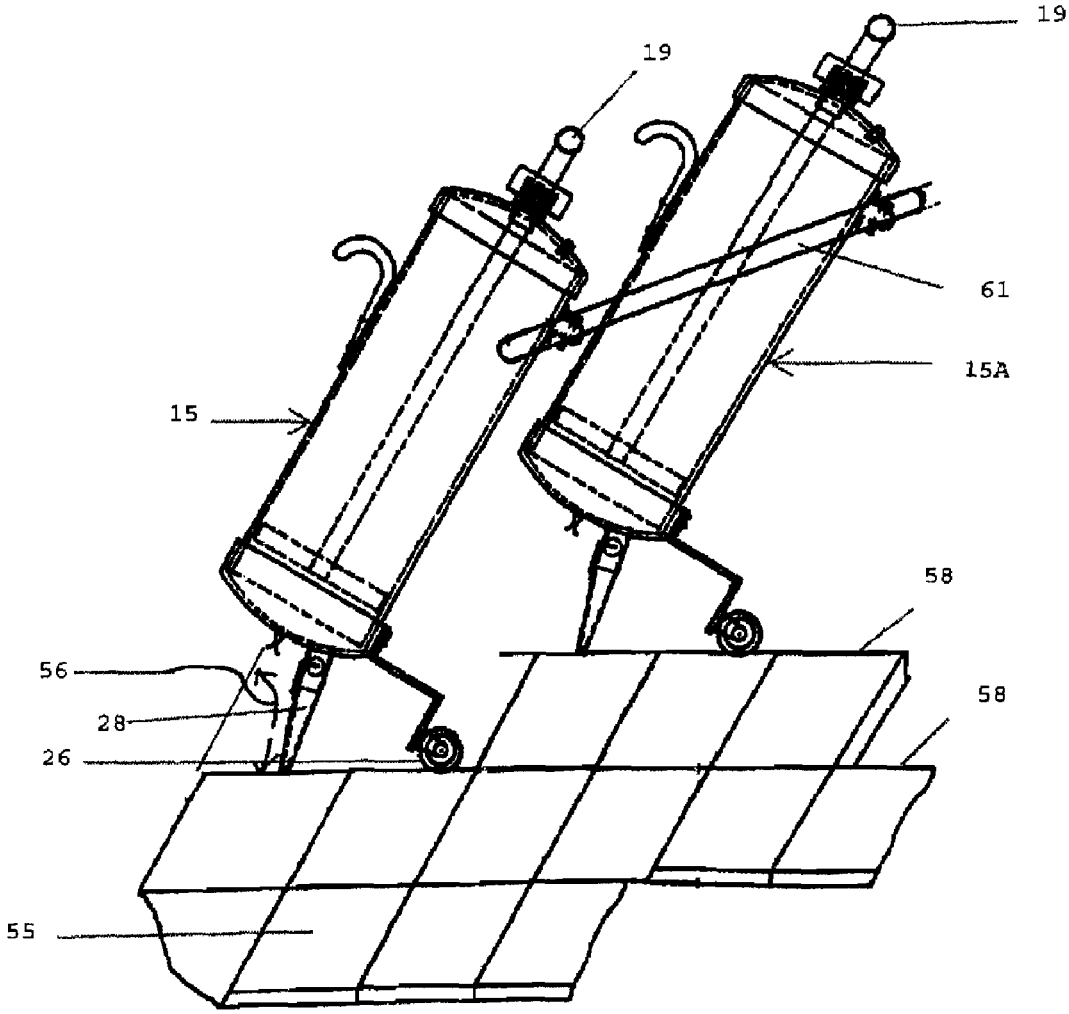
FIG. 6B is a side elevation view of two grout dispensers attached to one another as they would actually appear in use installing grout in between a number of installed tiles.

The body 15 of the dispenser 2 should be able to hold approximately a quart to a gallon of grout. By lowering the body 15 and the nipple 29 and the tracking wheel 26 into the track 58, the weight of the predetermined thickness grout easily slides down through the body 28. An applied force from the piston 24 pushes the grout out of the nipple 28. At the time of starting the job, the on-off handle 34 is at the shutoff position. Opening the handle 34 is done by it and locking it in the snap lock 32. The rotatable handle 19 makes easy for the worker to handle movement of dispenser 2. An arrow 57 shows the direction in which the worker pulls the dispenser 15. In addition to the presentation and the illustration in FIG. 5, another body 15A is added to the body 15 in order to double the extrusion of grout for faster work. The twin pack of bodies 15 and 15A is adjustable for tile sizes from 6, 8, 12, 16, and 18 inches as shown in FIG. 6. This means the grouting can be done in one-half the normal time, thus saving material, time and labor. Also there is less strain-stress on the worker.

Figure 7A:
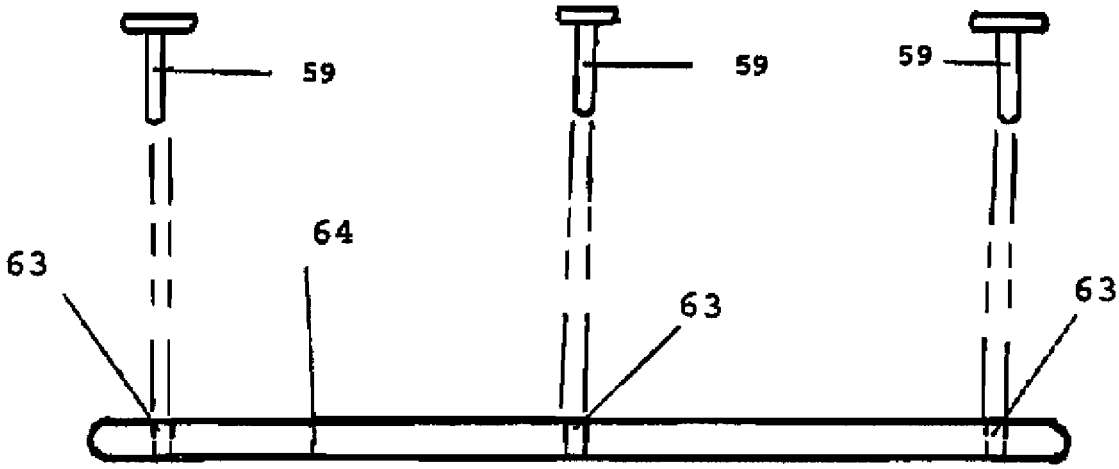
FIG. 7A is a cross-sectional exploded view of a supporting pipe/bar having three slots for pin insertion.
Figure 7B:
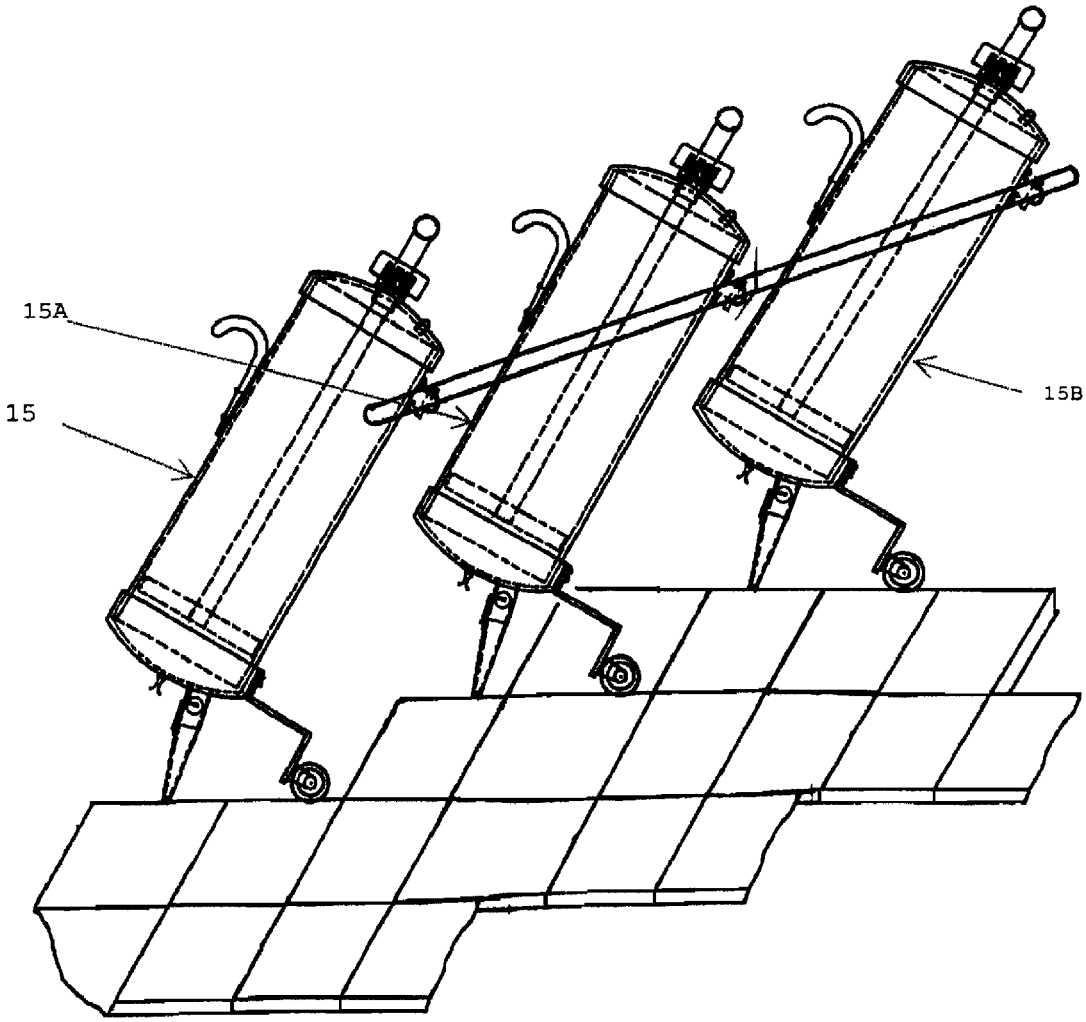
FIG. 7B shows a side elevation view of three grout dispensers attached to each other as they would actually appear in use installing grout in between a number of installed tiles.
Figure 8A:
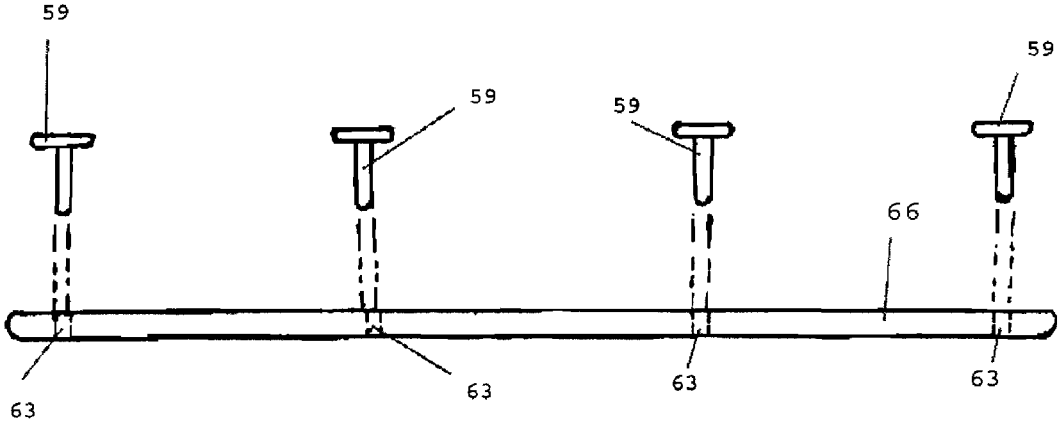
FIG. 8A is a cross-sectional exploded view of a supporting pipe/bar having four slots for pin insertion.
Figure 8B:
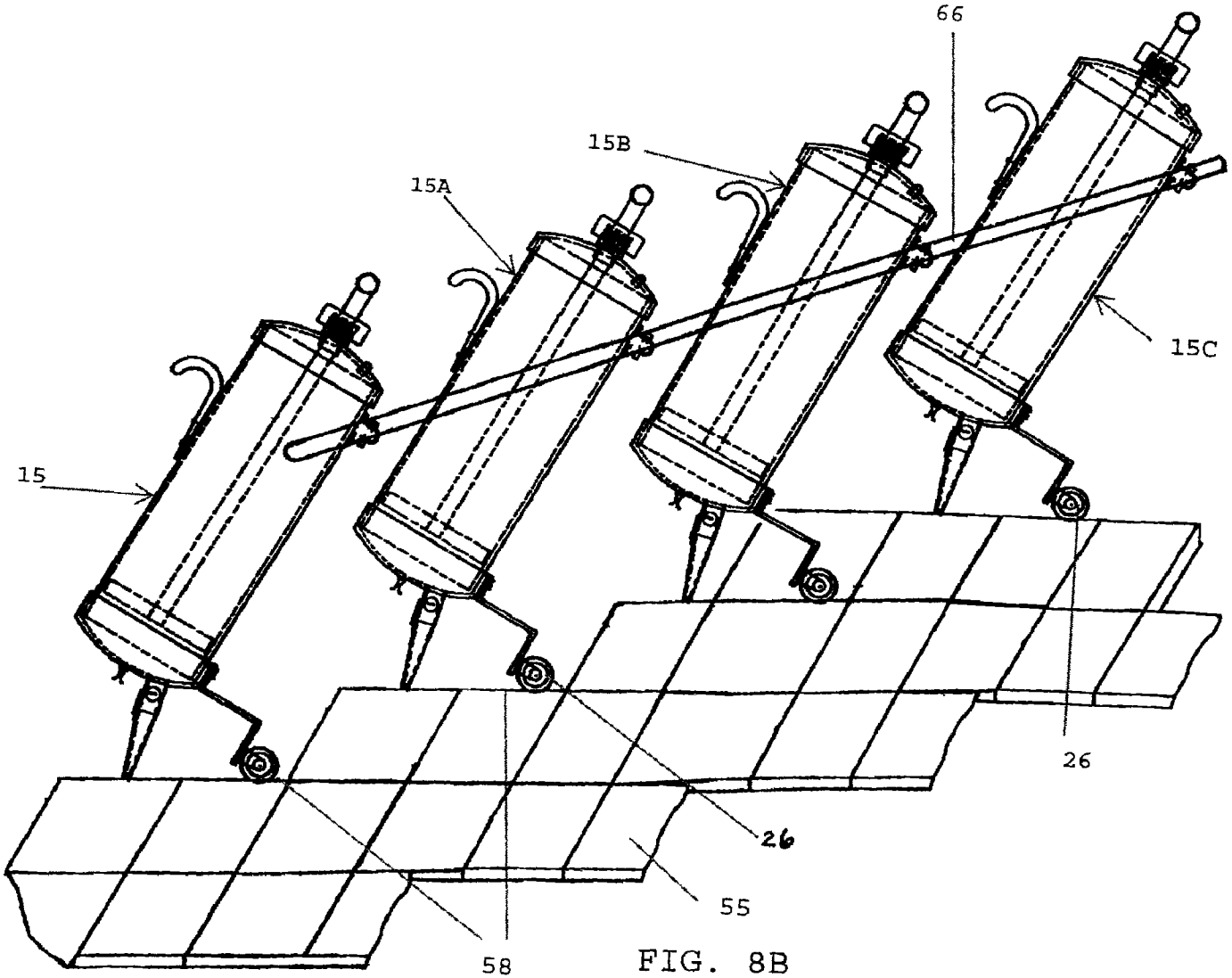
FIG. 8B shows a side elevation view of four grout dispensers attached to each other as they would actually appear in use installing grout in between a number of installed tiles.

Various sizes of tiles are manufactured by a tile manufacturer. Referring to FIG. 5, a single grout dispenser can be used for almost all the different sizes of tiles. The dispenser 15 takes care of any single track at a time. When the installed tiles get smaller, it will take more time for each track to be filled. As presented and illustrated in FIG. 6A, two dispensers 2 are put together for the different width of the installed tiles. As seen in FIG. 6, the slots 63 of the supporting pipe/bar 61 can be utilized for various locations of the dispensers from 6, 8, 12, 16, and 18 inches, just by pulling up the pins 59. After locating the tracks positions the pin 59 can be dropped back into the supporting pipe/bar 61. The first grout dispenser 2 always stays at the fixed position while the additional grout dispenser 15A can be moved to the right side as required per job. This method of doing the job cuts down the required time onto one-half the normal time. In addition to the presentations and to the illustrations in FIGS. 5 and 6A, an additional grout dispenser 15B can be added to the assembly of FIG. 6A, as shown in FIGS. 5, 7B, and 8B. The supporting pipe/bar 64 has several slots 63 for adjusting the dispensers. The body 15 stays fixed while bodies can be moved to the right side for the required jobs. The triple bodies of assembly of 15, 15A, and 15B cuts down the required time into one-third the normal time. As best depicted in FIG. 8B, another grout dispenser 15C can be added in order to quadruple the extrusion of grout for four rows of the tracks at the same time. The assembly of four bodies cuts down the required working time into one-fourth the normal time. As seen in FIG. 8A, the supporting pipe/bar 66 has many slots 63 for fixing the three dispensers at the required locations. The body 15 stays at the fixed position while bodies 15A, 15B and 15C can be moved to the right side. As mentioned before, the pins 59 are to be used to fix the different slots 63 as required per job demand.

Figure 3A:
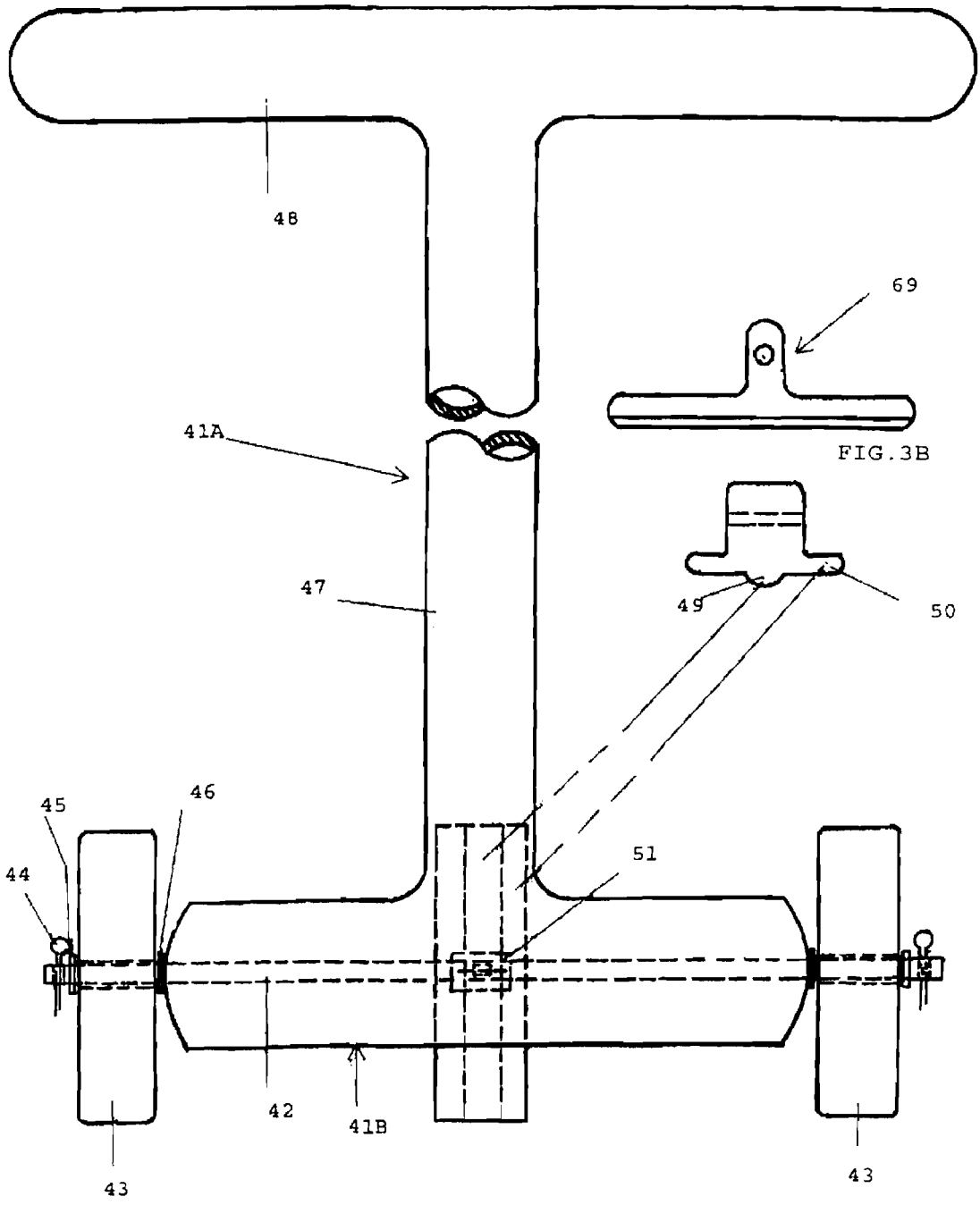
FIG. 3A is a perspective view of the float associated with the grout dispenser.
Figure 10:
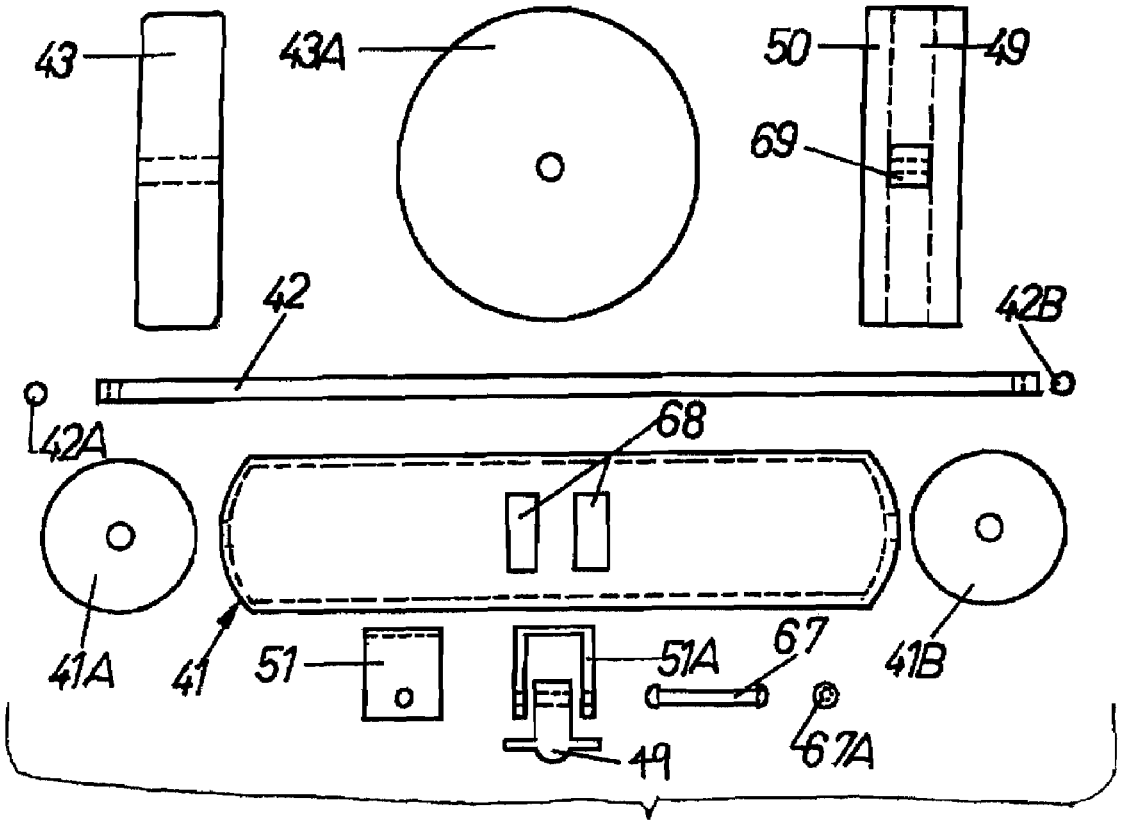
FIG. 10 is an exploded view of an alternative embodiment of a float.

In the preferred top plan view and exploded views of the embodiments as shown in FIGS. 9 and 10, respectively, the grout float device 41A and its parts are shown in the different views for the general understanding of the simple device. The concave mechanism 69 is shown in the track 58 and the wing 50, both sides, are shown on the installed tile 55 level. The wheels 43 and the wing 50 must be on the same level as the installed tiles level. The cylindrical rod 49, also illustrated in FIG. 3A, is surrounded closely by the width between two tiles. This suitable depth is helpful to give the uncured grout the concave appearance created by the rod 49.

In the preferred exploded views of the embodiments as shown in FIG. 11, the bottom cap 33 has an assembly of the bracket 25 and the tracking wheel 26, an orifice valve 27 and the nipple body 28. The snapping lock 32 locks the handle 34 for the opening position of an orifice valve 27. A view 24A shows a bottom view of the piston 24. A view 33A is a top view of the cap 33. A view 21A is the side view of the shank 21. The body 15 is the main body of the dispenser 15. The view 70A is the left and 70B is the right side views of the cylinder 70 of the body 15.

The device 18 as shown in FIG. 1 is an important part of piston 24. The device attaches the shank 21 to the cap 17 and locks the shank 21 at a desirable position. The male threaded device 18D, as shown is attached/welded to the center of the top cap 17. A packing neoprene gasket 18B goes into the top track of the device 18D and it remains there. The locking device 18A has a bottom track for the remaining part of the gasket. Thus the gasket 18B sits half in the device 18A and the remaining half in the device 18D. The view 18C is the top and the bottom views of the device 18B. Particularly, the exploded parts of the piston shank 21 locking/unlocking device 18, as shown in FIG. 11, are important because as the piston 24 is compressed on the contain in the cylinder 70, it can be locked by turning the device 18 to left, and to right to unlock. The pressure is applied on the shank 21 by device 18, by squeezing the neoprene gasket 18B. The view 18E shows the out side diameter of the shank 21. The views 18F, 18G, and 18H are the top views of the device 18.

Figure 12A:
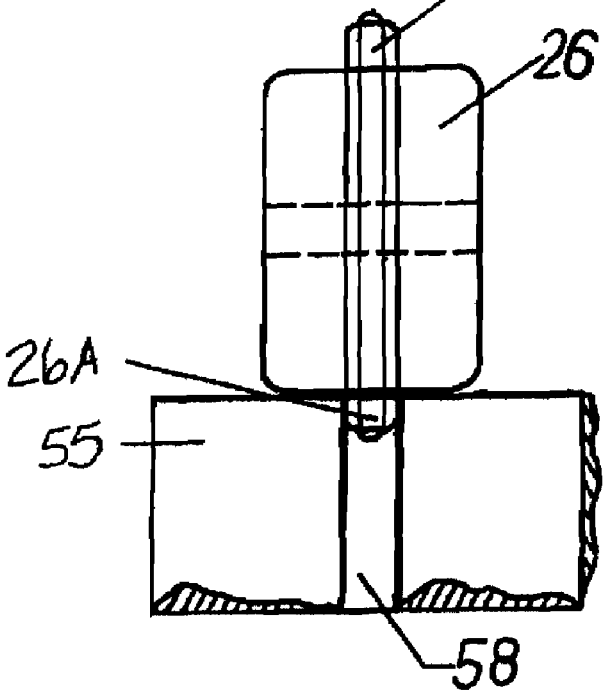
FIG. 12A is a front elevation view of the tracking wheel embedded, surrounding closely in the tracks of the installed tiles.
Figure 12B:
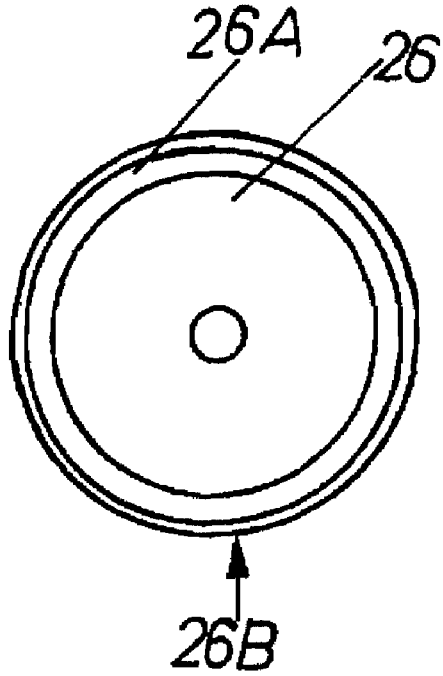
FIG. 12B is a side elevation view of the tracking wheel embedded, surrounding closely in the tracks of the installed tiles.

As best illustrated in FIGS. 12A and 12B, the smaller wheel 26 and a circle wheel 26A are surrounded closely by the track 58. The wheel 26 rests on the surface of the installed tiles whereas the band like circle wheel 26A travels through the track 58. An arrow 26B indicates the right side view of the wheel 26 and 26A combined.

Figures 13, 14A, 14B, 15:
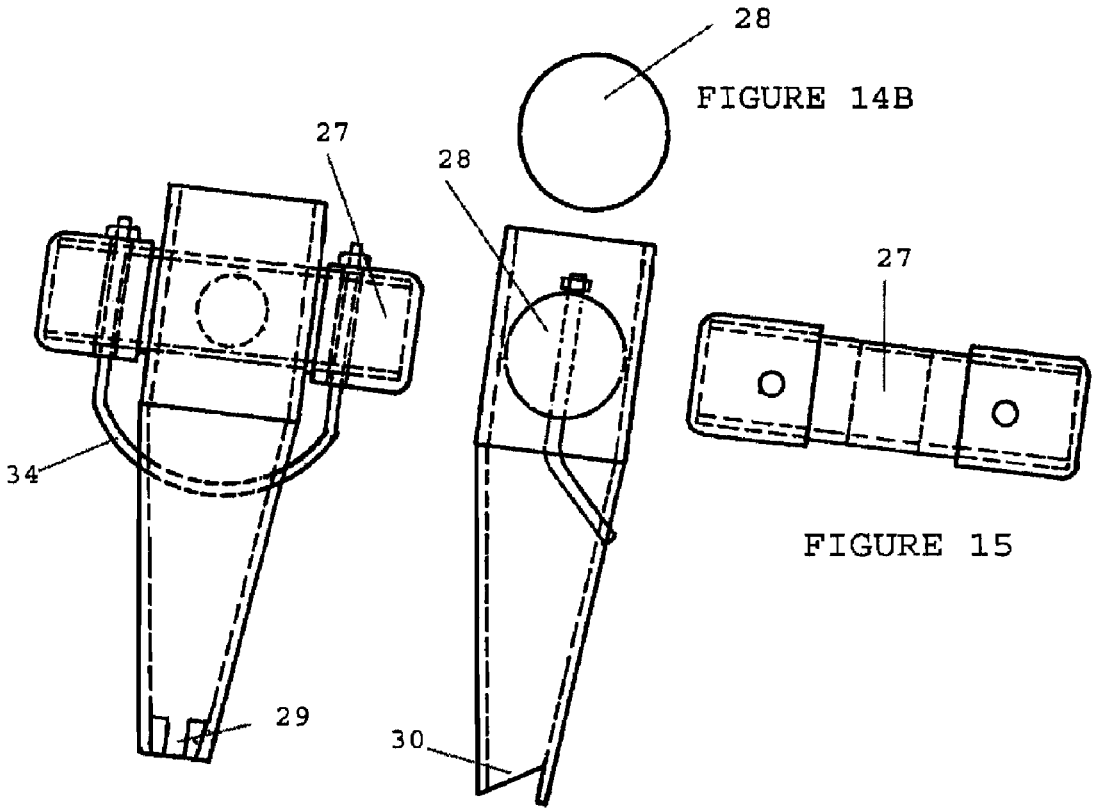
FIG. 13 is a perspective rear view of the nipple attached to the bottom cap.
FIG. 14A is a perspective rear view of the nipple attached to the bottom cap.
FIG. 14B is a top plan view of a nipple.
FIG. 15 illustrates an embodiment of the orifice valve in an open position.

As illustrated in FIG. 13, a rear elevation view of the body 28 is shown with locking handle 34. An orifice valve 27 is shown here in a shut position of the body 27. The square toothed nipple 29 is shown here as a front view of the body 28.

In FIG. 14, the left side elevation view of the square toothed nipple of the nipple 28 and the handle 34 at the off position is shown. FIG. 14B is a top plan view of the nipple 28.

As depicted in FIG. 15, an orifice valve 27 is illustrated here separately to show the open position of the valve 27 whereas in FIG. 13 it shows at the shut position.

The illustrations of the invention in FIGS. 1 through 14, thus stipulates that the grout capable of filling the tracks of the various widths, dispensers between the installed tiles. The most practical and the combination of the preferred embodiments is to be considered the most from ⅛" to ¾" spaces device. As far as the invention of the float 41 is concerned, separately, it can be used at any floor tile installation, however, small or big.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A grout dispenser comprising:

(a) a body having two ends comprising a top end and a bottom end, (b) a first cap attached to the top end of the body, (c) a second cap attached to the bottom end of the body, (d) a volume of grout placed within the body of the grout dispenser, (e) means for refilling the body of the dispenser with more grout, (f) means for dispensing the grout into a track, and (g) means for attaching multiple grout dispensers to one another.

2. A grout dispenser according to claim 1 wherein the means for dispensing the grout into a track further comprises:

(a) a track located on a flat surface, (b) a shank having two ends comprising a top end and a bottom end, the top end of the shank extending through the first cap attached to the top end of the body, (c) a piston attached to the bottom end of the shank, the piston having a diameter slightly less than the inner diameter of the body, (d) a handle attached to the top end of the shank, (e) a piston shank locking/unlocking device attached to the first cap, the locking/unlocking device designed to removably attach the shank to the first cap, (f) exit means for forcing the grout within the body out through the second cap onto the track, (g) locomotive means for moving the grout dispenser along while an amount of grout is being placed into the track, and (h) means for smoothing out the grout within the track after the grout has been deposited into the track.

3. A grout dispenser according to claim 2 wherein the exit means for forcing the grout within the body out through the second cap further comprises (a) a nipple having two ends, a first end and a second end, the first end of the nipple being fixedly attached to the second cap, (b) an opening located in the second end of the nipple, (c) a valve located within the nipple, the valve having two positions comprising an "open" position and an "shut" position, wherein the valve being in the "open" position will allow grout within the body to exit through the nipple, and further wherein the valve being in the "shut" position will prevent the grout within the body from exiting the body, (d) means for controlling whether the valve is in an "open" position or an "shut" position.

4. A grout dispenser according to claim 3 wherein the means for controlling whether the valve is in an "open" position or a "shut" position further comprises:

(a) a handle attached to the valve, (b) a snap lock attached to the second cap, (c) wherein the handle, when attached to the snap lock, places the valve into an "open" position, and (d) further wherein the handle, when not attached to the snap lock, causes the valve to be in the "shut" position.

5. A grout dispenser according to claim 4 wherein the locomotive means for moving the grout dispenser along while an amount of grout is being placed into the track further comprises:

(a) a bracket attached to the second cap, (b) a tracking wheel attached to the bracket, (c) wherein the grout dispenser can be placed at an angle in relation to the floor surface, whereby the opening on the nipple is located just above the track, further whereby the tracking wheel is located on the flat surface immediately above the track.

6. A grout dispenser according to claim 5 wherein the means for smoothing out the grout within the track after the grout has been deposited into the track further comprises:

(a) an exterior band attached circumferentially to the tracking wheel attached to the bracket, (b) wherein the exterior band slides over the top of the grout laid in the track by grout exiting the nipple, (c) further wherein the exterior band smoothes the grout within the track that it comes in contact with.

7. A grout dispenser according to claim 6 wherein the grout dispenser further comprises a hook, the hook being attached to the body of the grout dispenser.

8. A grout dispenser according to claim 7 wherein the means for attaching multiple grout dispensers to one another further comprises (a) a bracket attached to the body of each grout dispenser, (b) a bar, the bar being attached to each bracket, and (c) fastening means for securing each bracket attached to the body of each grout dispenser to the bar.

9. A grout dispenser according to claim 7 wherein the means for mounting the body for storage or for refilling the body of the dispenser with more grout further comprises a utility stand, the stand comprising:

(a) a quartet of vertical supports, and (b) means for attaching the vertical supports to one another.

10. A grout dispenser according to claim 9 wherein the means for attaching the vertical supports to one another further comprises (a) an upper circular band, (b) a lower circular band, (c) a plurality of hardware, (d) wherein the hardware is used to attach the upper circular band and the lower circular band to the vertical supports.

* * * * *